United States Patent [19]

Iwai et al.

[11] 4,381,724

[45] May 3, 1983

[54] COAL FIRED SHIP

[75] Inventors: Kiyoshi Iwai, Kashiwara; Shinjiro Goto, Kyoto, both of Japan

[73] Assignee: Hitachi Shipbuilding and Engineering Company, Limited, Osaka, Japan

[21] Appl. No.: 241,097

[22] Filed: Mar. 6, 1981

[30] Foreign Application Priority Data

Mar. 21, 1980 [JP] Japan ..... 55-37520[U]

[51] Int. Cl.[3] ..... B63B 11/04

[52] U.S. Cl. ..... 114/65 R; 114/73

[58] Field of Search ..... 114/72, 73, 74 R, 65 R

[56] References Cited

U.S. PATENT DOCUMENTS

| | | | |
|---|---|---|---|
| 1,307,983 | 6/1919 | Lynn | 114/72 |
| 1,391,946 | 9/1921 | Frear | 114/73 |
| 1,953,389 | 4/1934 | Bolton et al. | 114/74 R |
| 3,272,168 | 9/1966 | Donohue et al. | 114/74 R |
| 3,362,370 | 1/1968 | Morrell | 114/74 R |

FOREIGN PATENT DOCUMENTS

| | | | |
|---|---|---|---|
| 825717 | 12/1959 | United Kingdom | 114/74 R |

*Primary Examiner*—Sherman D. Basinger

*Attorney, Agent, or Firm*—Barnes, Kisselle, Raisch, Choate, Whittemore & Hulbert

[57] ABSTRACT

A coal fired ship comprising a transverse bulkhead disposed between the rearmost hold in the stern and the engine room and bent or curved at its center portion to project into the engine room and thereby provide a main coal bunker between the hold and the engine room. An interior dead space of the ship is effectively utilized to provide the bunker without reducing the floor space of the engine room or the hold capacity and with the ship maintained in trim although the bunker is disposed in front of the engine room.

7 Claims, 5 Drawing Figures

COAL FIRED SHIP

The present invention relates to a coal fired ship, and more particularly to a coal fired ship in which dead spaces are effectively utilized to provide coal bunkers in front of the engine room.

Due to price hikes of fuel oil in recent years, coal fired ships have attracted attention again. Especially such ships as bulk coal carriers have proved fully commercially feasible. However, the problem heretofore encountered in providing a coal bunker in front of the engine room (i.e. at the best-suited location) for storing coal for use as the fuel is that there is the need to increase the length of the ship or decrease the engine room space or hold capacity by the corresponding amount.

The object of the present invention which has been accomplished in view of this problem is to provide a coal fired ship in which coal bunkers are disposed in front of the engine room without decreasing the floor space of the engine room and the hold capacity while permitting the ship to maintain trim by the stern.

To fulfill this object, the invention provides a coal fired ship comprising a transverse bulkhead disposed between the rearmost hold in the stern and the engine room and bent or curved at its center portion to project into the engine room and thereby provide a main coal bunker between the hold and the engine room.

The main coal bunker thus formed effectively utilizes the dead space between the transverse bulkhead and the hold without reducing the floor space of the engine room or the hold capacity as will be described later in detail.

According to a preferred embodiment of the invention, the coal fired ship has, in addition to the main coal bunker, wing coal bunkers provided in the spaces between the upper deck and walls of the hold at the opposite sides of the ship and having coal outlets open to the main coal bunker, and said coal bunkers provided in the spaces immediately below the living quarters of the ship adjacent to and on the opposite sides of the engine room and having coal outlets open to the main coal bunker.

The wing coal bunkers and the side coal bunkers are thus provided for storing a large quantity of coal because coal has about ½ the calorific value (kcal/kg) of oil and also because the ship can be replenished with coal only at specified ports.

Various features and advantages of the invention will become apparent from the following description of a preferred embodiment with reference to the accompanying drawings, in which.

Figure 1:
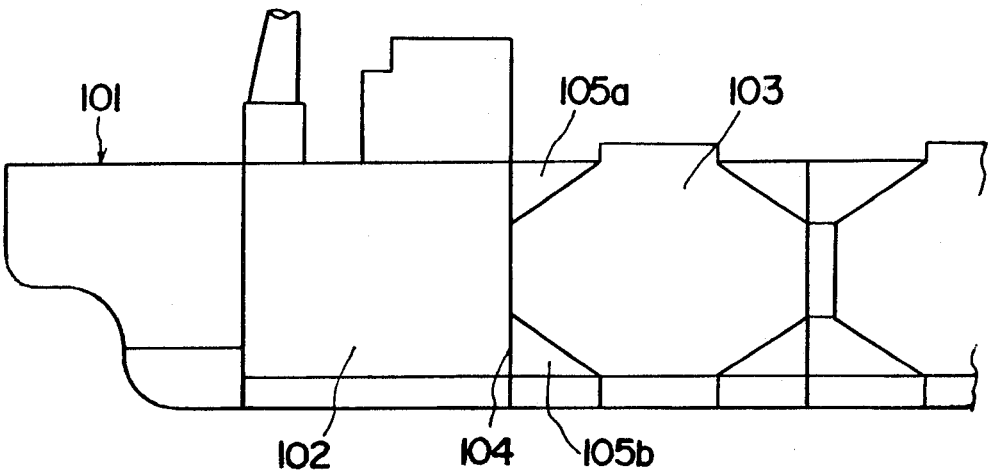
FIG. 1 is a view in vertical section showing the construction of a conventional ship.
Figure 3:
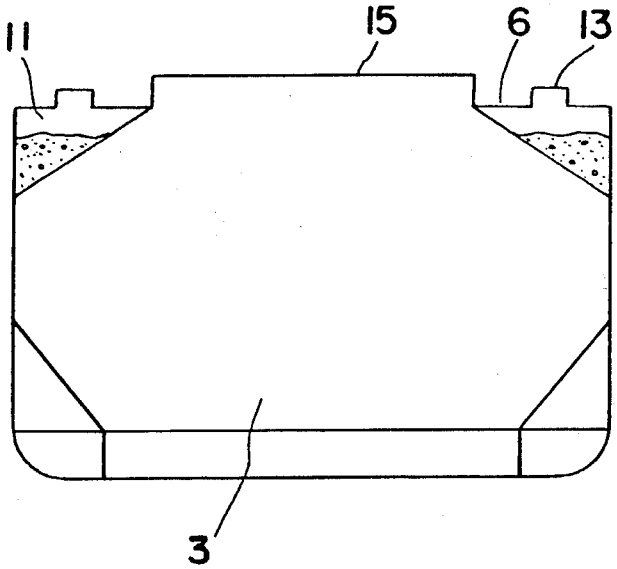
FIG. 3 is a view in section taken along the line A—A in FIG. 2.
Figure 2:
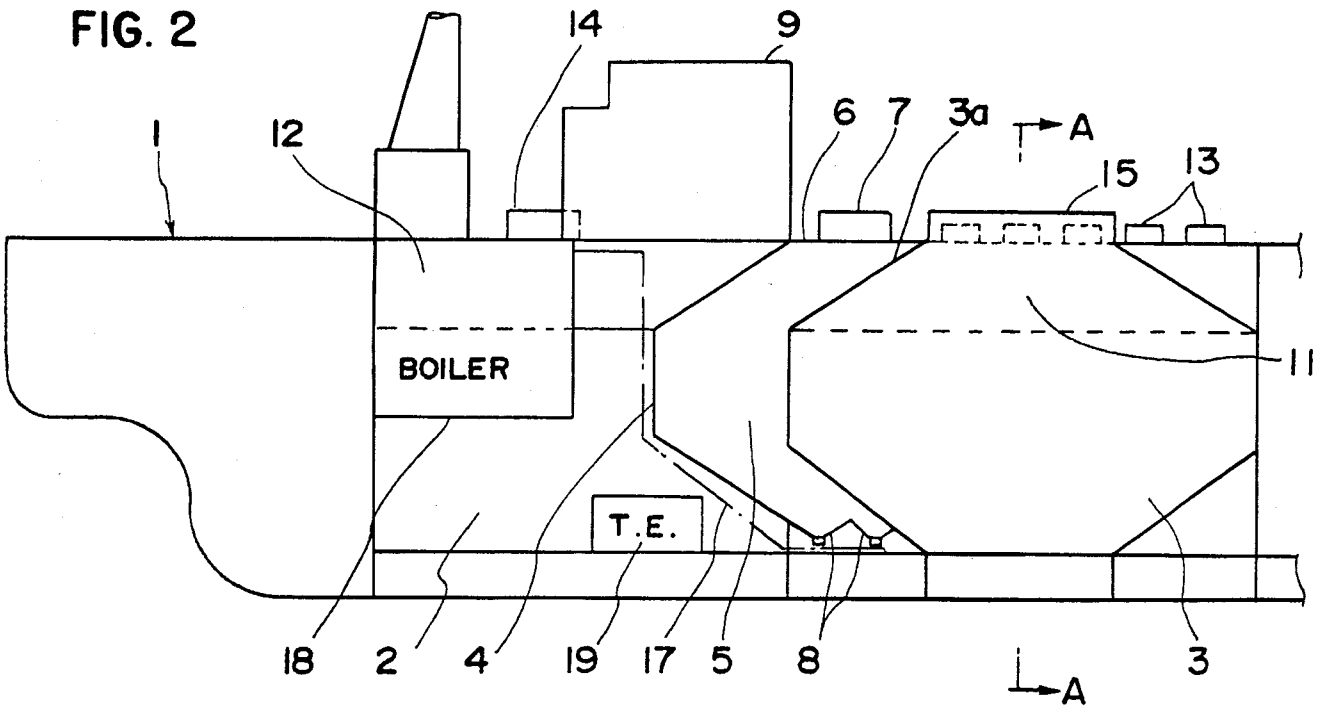
FIG. 2 is a view in vertical section showing an embodiment of the invention.
Figure 4:
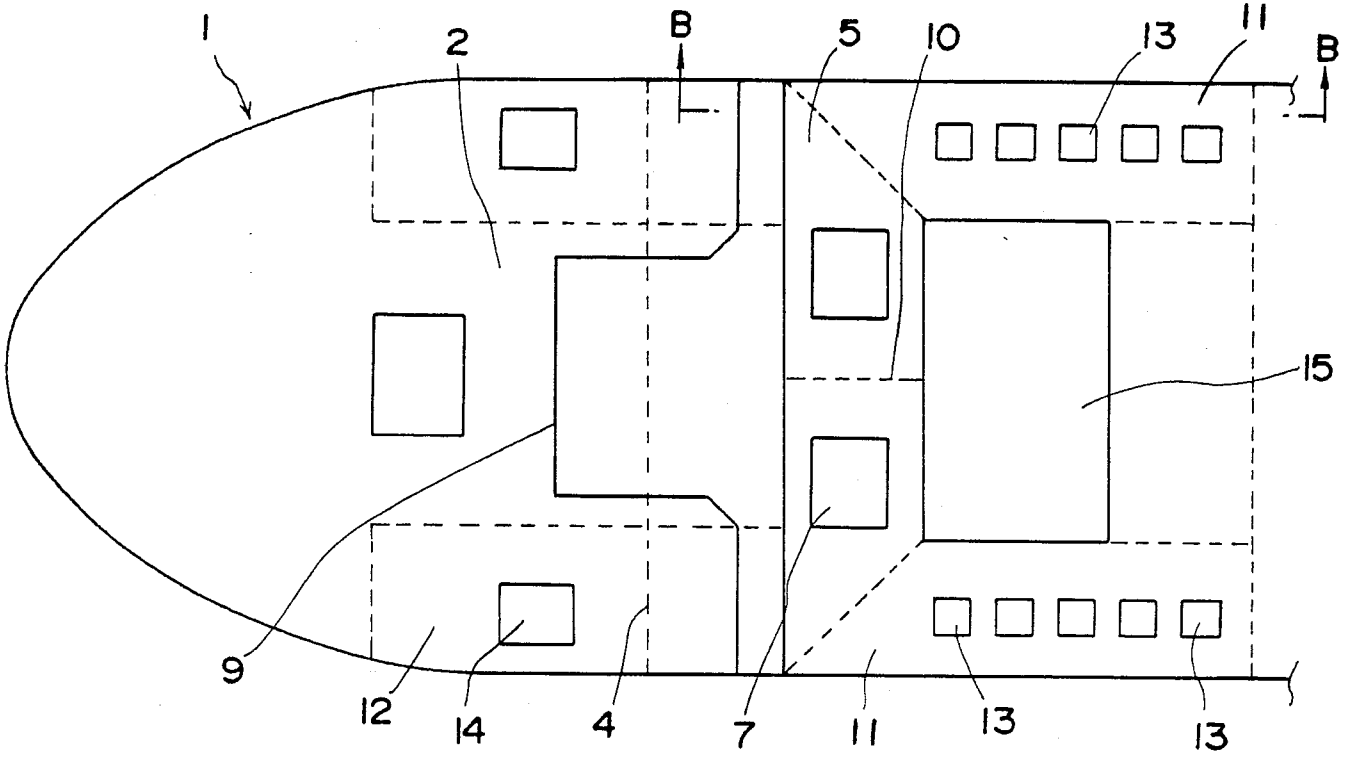
FIG. 4 is a plan view of FIG. 2.

Before describing an embodiment of the invention, the construction of a conventional ship will be described with reference to FIG. 1. As illustrated, the conventional ship has a vertical bulkhead 104 between an engine room 102 and the rearmost hold 103 in the stern within a hull 101. Spaces 105*a* and 105*b* are formed between the bulkhead 104 and the hold 103.

Although usable as ballast tanks, the spaces 105*a* and 105*b* are substantially dead spaces. If possible, it is desired to utilize these dead spaces for other purposes while maintaining the ship in trim.

The present invention, which contemplates effective use of the dead spaces as coal bunkers, will be described below with reference to the embodiment shown in FIGS. 2 to 5.

FIGS. 2 to 5 show a hull 1, an engine room 2, the rearmost hold 3 in the stern and a transverse bulkhead 4. The transverse bulkhead 4 is bent at its center portion to project into the engine room 2 and has, when seen in section along the center line, a straight upper portion declining toward the stern, a straight intermediate portion perpendicular to the bottom of the ship and a straight lower portion declining toward the bow. A main coal bunker 5 is formed between the bent transverse bulkhead 4 and an outer wall 3*a* of the hold 3. Coal is placed into the coal bunker 5 through coal inlet hatches 7 formed in the upper deck 6 and is delivered from hoppers 8 provided at a lower portion of the coal bunker 5. The upper and lower ends of the transverse bulkhead 4 are positioned in a plane extending through the wall, toward the bow, of living quarters 9 to support the weight of the upper structure by the transverse bulkhead 4. When the degree of projection of the intermediate portion is great or the upper structure has a large weight, a longitudinal bulkhead 10 in conformity with the shape of the bunker 5 is provided for reinforcement.

The present embodiment includes, in addition to the main coal bunker 5, wing coal bunkers 11 formed in the spaces between the upper deck 6 and the walls of the hold 3 at the opposite sides of the ship and having coal outlets open to the main coal bunker 5, and side coal bunkers 12 formed in the spaces immediately below the living quarters 9 adjacent to and on the opposite sides of the engine room 2 and having coal outlets open to the main coal bunker 5 to afford an increased coal storing capacity. The wing coal bunkers 11 and the side coal bunkers 12 have coal inlet hatches 13 and 14 respectively. Indicated at 15 is a cargo inlet hatch.

Figure 5:
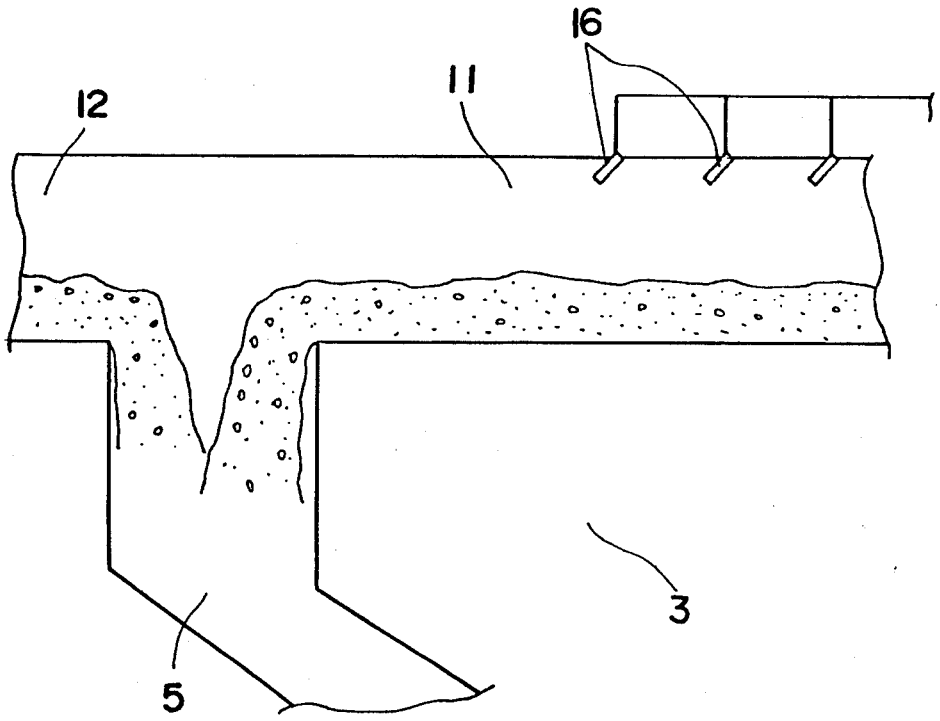
FIG. 5 is a view in section taken along the line B—B in FIG. 4.

With the present embodiment, coal is transferred from the wing coal bunkers 11 to the main coal bunker 5 by discharging jet water or compressed air from jet nozzles 16 arranged longitudinally of the ship as seen in FIG. 5. When jet water is used, walls of the hold 3 is provided with drains for causing the wet portion of coal to fall into the main coal bunker 5 while removing water therefrom. Alternatively the bunkers 11 may be provided with belt conveyors or like conveyors or other suitable means in place of the jet nozzles 16 for the transfer of coal. The same coal transfer means as above are of course usable for the side coal bunkers 12.

The coal stored in the main coal bunker 5 is drawn off from the hoppers 8 and sent through a line 17 to a coal feeder associated with a boiler 18. The feeder supplies the coal to the boiler 18. Coal can be sent through the line 17, for example, by dropping coal into a pressure container in communication with the hoppers 8 and introducing compressed air into the container to forward the coal with the air pressure. Coal can of course be transported to the coal feeder by the combination of a conveyor extending horizontally on the floor of the engine room 2 and another conveyor extending vertically from the floor.

Indicated at 19 is a turbine engine which is partly accommodated in the space formed between the lower portion of the transverse bulkhead 4 and the floor of the engien room 2, so that the interior space of the engine room 2 is effectively utilized. The projection of the intermediate portion of the transverse bulkhead 4 into the engine room 2 causes no trouble to the arrangement of other devices but also assures effective use of the engine room space.

Although the coal inlet hatches 14 already mentioned are both usable for placing coal into the side coal bunkers 12, only one of the hatches 14 is usable, for example, when the ship is alongside a pier at one side of the hull 1. A conveyor, if provided for interconnecting the two side coal bunkers 12, is useful for storing coal in both bunkers 12. The same expedient can be provided for the wing coal bunkers 11.

Further when a vibrator or like device is disposed at an upper portion of the hopper 8, the device serves to eliminate the likelihood that coal will form a bridge at the upper portion without falling down. For a short-distance navigation, the wing coal bunkers 11 or the side coal bunkers 12 are usable as ballast tanks for trimming the ship, while when the ship is designed initially for short-distance navigations, the bunkers 11 and 12 need not always be provided.

According to the present invention which will be apparent from the foregoing embodiment, the portion which has heretofore been left unused as a dead space can be effectively utilized as a main coal bunker, and the main coal bunker can be provided in front of the engine room, i.e. at the best-suited location. Because the transverse bulkhead, which is merely bent to form a projecting intermediate portion, is fixed at its upper and lower ends to the same locations as in conventional ships, and further because no special separate space is formed for use as a coal bunker, the arrangement of the invention can be realized without reducing the floor space of the engine room or the hold capacity and with the ship maintained in trim. Additionally the wing coal bunkers and side coal bunkers, when provided, give an increased coal storage capacity, enabling the ship to navigate over long distances.

What is claimed is:

1. A coal fired ship comprising, from stern to stem, an engine room, a main coal bunker next to the engine room and separated therefrom by a transverse bulkhead, and at least one hold next to the main coal bunker, wherein said one hold has its aft wall projecting at the center portion thereof toward the stern to provide upper and lower spaces between the deck and the hold and between the bottom and the hold respectively, and said main coal bunker incorporating said spaces is formed between said transverse bulkhead and said aft wall by bending or curving the bulkhead at its center portion to project into the engine room.

2. A coal fired ship as defined in claim 1 wherein the transverse bulkhead comprises, in the elevation at the center line, a straight upper portion declining toward the stern, a straight intermediate portion perpendicular to the bottom of the ship and a straight lower portion declining toward the bow.

3. A coal fired ship as defined in claim 1 or 2 wherein the bunker has a coal outlet at a lower portion thereof.

4. A coal fired ship as defined in claim 1 or 2 wherein the upper and lower ends of the transverse bulkhead are positioned in a plane extending through the wall toward the bow of living quarters.

5. A coal fired ship as defined in claim 1 or 2 wherein the bunker has in its interior at least one longitudinal bulkhead conforming to the shape of the bunker.

6. A coal fired ship as defined in claim 1 wherein wing coal bunkers each having a coal outlet open to the main coal bunker are provided in the spaces between the upper deck and the walls of the hold at the opposite sides of the ship.

7. A coal fired ship as defined in claim 1 wherein side coal bunkers each having a coal outlet open to the main coal bunker are provided in the upper spaces immediately below the living quarters, adjacent to and on the opposite sides of the engine room, said side coal bunkers extending for the full length of the engine room.

* * * * *